US005077987A

United States Patent [19]

Leith, III

[11] Patent Number: 5,077,987

[45] Date of Patent: * Jan. 7, 1992

[54] INTERCHANGEABLE EARRING HOLDER

[75] Inventor: Edwin L. Leith, III, Arnold, Mo.

[73] Assignee: Marijana T. Leith, Arnold, Mo. ; a part interest

[ * ] Notice: The portion of the term of this patent subsequent to Sep. 26, 2006 has been disclaimed.

[21] Appl. No.: 468,744

[22] Filed: Jan. 24, 1990

[51] Int. Cl.[5] ..... A44C 7/00

[52] U.S. Cl. ..... 63/13

[58] Field of Search ..... 63/12, 13, 14.1, 14.3, 63/14.4, 14.5, 14.6, 14.8; 24/601.5, 599.2

[56] References Cited

U.S. PATENT DOCUMENTS

| | | | |
|---|---|---|---|
| 2,292,116 | 8/1942 | Goodwin | 24/599.2 X |
| 2,923,045 | 2/1960 | Mount | 24/601.5 |
| 3,208,239 | 9/1965 | Pintarelli | 63/12 |
| 3,975,921 | 8/1976 | Pomaski | 63/13 |
| 4,829,789 | 5/1989 | Tsamas | 63/14.3 |
| 4,869,078 | 9/1989 | Leith et al. | 63/13 |

FOREIGN PATENT DOCUMENTS

| | | | |
|---|---|---|---|
| 1904 | of 1874 | United Kingdom | 63/12 |
| 3031 | of 1881 | United Kingdom | 63/12 |

*Primary Examiner*—James R. Brittain

*Attorney, Agent, or Firm*—Polster, Lieder, Woodruff & Lucchesi

[57] ABSTRACT

An interchangeable earring holder is disclosed for interchangeably receiving at least one of a variety of different earring accessories. The earring holder includes an earring holder body and earring support means in the form of a hook shaped member which is pivotally mounted relative to the lower end of the earring holder body. The hook shaped member is pivotally mounted between an open position extending generally transverse to the body for interchangeably receiving at least one earring accessory and a closed position where the hook shaped member is generally aligned with the earring holder body. The hook shaped member and the earring holder body are constructed for releasable interengagement when the hook shaped member extends generally aligned with the earring holder body. Preferably, the earring holder body includes a depression formed in a lower end thereof for receiving an outer free end of the hook shaped member in releasable locking engagement therewith. The hook shaped member is also preferably constructed as a spring member enabling the outer free thereof to be mounted in spring biased releasable engagement with the depression formed in the lower end of the earring holder body. When the hook shaped member is pivoted to an open position, extending generally transverse to the earring holder body, a variety of different types of earring thereafter accessories may be mounted over the hook shaped member. Thereafter, the hook shaped member is moved to its closed position in general alignment with and releasably locked to the earring holder body in the aforesaid manner.

9 Claims, 1 Drawing Sheet

INTERCHANGEABLE EARRING HOLDER

BACKGROUND OF THE INVENTION

The present invention relates to an interchangeable earring holder for interchangeably receiving at least one of a variety of different earring accessories in an open position and thereafter being closed in a releasable locked position.

The present invention is an improvement over U.S. Pat. No. 4,869,078 dated Sept. 26, 1989 and entitled "Earring Holder".

As recognized in the aforementioned patent, most women have a great variety of types and kinds of earrings which are in different shapes, styles and colors to match the type of clothes worn, the time of day and the function to be attended. Unfortunately, many women cannot wear pierced costume earrings because they experience infections caused by the non-precious metal in earring jewelry. As a result, many women find that they are unable to wear costume earrings that they have already purchased or would like to purchase, for a particular use or occasion. To make matters worse, although 14 Karat gold earrings can help alleviate this problem, many women cannot justify the much greater expense of owning several pairs of gold earrings.

As disclosed in U.S. Pat. No. 4,869,078, a spring loaded hook section may be moved between an open position where the spring loaded hook section extends transverse to an earring holder body for interchangeably mounted at least one earring accessory and a closed position where the spring loaded hook member is generally aligned with the earring holder body for releasably securing at least one earring accessory in spring biased relationship to the earring holder body. In that patent, a convolutely wound spring extends about an elongated rod section of the hook member and is positioned within a hollow body portion of an earring holder body, in order to enable the hook member to be moved between the aforesaid open and closed positions.

While the specific construction shown in the aforementioned patent works quite well and in the manner desired, it has been discovered that the inclusion of several parts and their assembly to one another may result in a higher cost than is desired. Further, with these several parts, there is added complexity in the assembly steps and the further risk that the end product may have a shorter life cycle than expected.

The new and improved interchangeable earring holder construction of the present invention overcomes such problems, while retaining all of the desirable features of this patent. As a result, the interchangeable earring holder construction of the present invention continues to provide flexibility to the consumer in mixing and matching an unlimited variety of decorative fine gold or costume pieces with the interchangeable earring holder of the present invention, while substantially facilitating use of the product, manufacturing techniques, the attendant cost involved, and the life cycle of the product.

SUMMARY OF THE INVENTION

Among the several objects and advantages of the present invention may be noted:

The provision of a new and improved interchangeable earring holder for interchangeable earrings;

The provision of the aforementioned earring holder which is movable between an open position and a closed position, the latter position providing releasable locking engagement between operative components;

The provision of the aforementioned earring holder which includes a hook shaped member that is pivotally mounted to an earring holder body and includes an outer free end which is releasably interlocked relative to the lower end of the earring holder body;

The provision of the aforementioned earring holder wherein the hook shaped member includes a threaded post for threaded engagement relative to the earring holder body, the hook shaped member also being pivotally mounted to the earring holder body along the threaded post thereof;

The provision of the aforementioned earring holder wherein the hook shaped member is constructed as a curvilinearly extending hook shaped spring member terminating in an outer free end for spring biased releasable interengagement with a complementary configured depression in the lower end of the earring holder body;

The provision of the aforementioned earring holder which quickly and efficiently facilitates the interchangeable mounting of various earring accessories relative to the hook shaped member when moved to its open position;

The provision of the aforementioned earring holder which can be made in gold or other precious metals to overcome infection or allergic reactions to non-precious metals, while at the same time, enabling a variety of different earring accessories made from non-precious metals to be interchangeably mounted relative to the earring holder; and The provision of the aforementioned earring holder which is constructed for simple and efficient well known manufacturing techniques using a minimum number of parts, provides an economical method of construction, is extremely simple to operate and use, is durable and long lasting, and is otherwise well adapted for the purposes intended.

Briefly stated, an earring holder for interchangeably receiving at least of a variety of different earring accessories includes an earring holder body, earring support means depending from the earring holder body, and ear attachment means operably associated with the earring for attaching the earring holder to a user's ear. The earring support means includes a hook shaped member pivotally mounted relative to a lower end of the earring holder body. The hook shaped member is pivoted between an open position extending generally transverse to the earring holder body for interchangeably receiving at least one earring accessory in a closed position when the hook shaped member is generally aligned with the earring holder body. The hook shaped member and the earring holder body are constructed for releasable interengagement therebetween when the hook shaped member is generally aligned relative to the earring holder body.

The hook shaped member is pivotally mounted to a lower end of the earring holder body, as well as being threadably engaged to the earring holder body in the area of the pivotal mounted thereof. The hook shaped member includes a threaded post at one end thereof for complementary threaded engagement relative to the earring holder body while the hook shaped member is pivotally mounted to the earring holder body along the threaded post. The hook shaped member further includes an outer free end at the other end thereof which is constructed to releasably engage the lower end of the earring holder body. For this purpose, a depression is formed in the lower end of the earring holder body for receiving the outer free end of the hook shaped member in releasable locking engagement therewith.

The hook shaped member is constructed as a one-piece curvilinearly extending hook shaped spring member enabling the outer free end thereof to be mounted in spring biased releasable engagement with the depression formed in the lower end of the earring holder body. Preferably, the hook shaped spring member is also constructed from a spring material.

Aforementioned U.S. Pat. No. 4,869,078 discloses various types of ear attachment means including a curvilinear ear hole hook connected to the earring holder body, an ear post and complementary releasable locking device, an adjustable clip connected to the earring holder body, and an adjustable clip including a rotatably mounted adjustable ear pad mounted relative to a U-shaped clip or a spring biased clip adapted to releasably engage an ear lobe of a user. All of the ear attachment means disclosed in the aforementioned patent are herein incorporated by reference thereto.

These and other objects and advantages of the present invention will become more apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptions, variations, alternatives and uses of the invention, including what I presently believe is the best mode of carrying out the invention.

Figure 5:
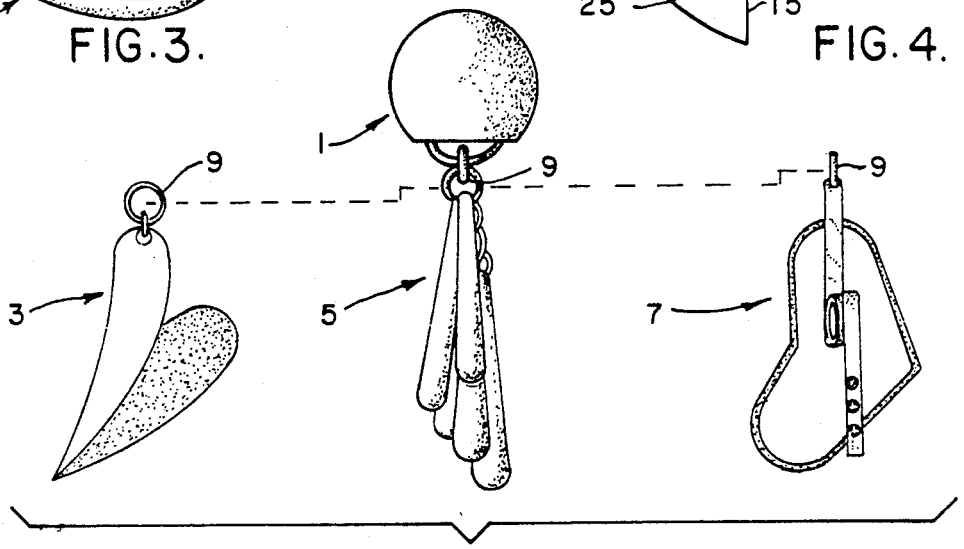
FIG. 5 front elevational view of the earring holder of the present invention with several different types of earring accessories that my be interchangeably mounted relative to the earring holder.

As shown in the drawing, an earring holder 1, to be described in detail hereafter, is constructed for interchangeably receiving at least one of a variety of different earring accessories. In FIG. 5 of the drawing, the earring holder 1 is shown as being used with the modified "heart" earring accessory 3 or the dangling elongated tear drop earring accessory 5 or the combined modified heart and stylized strap earring accessory 7, or any other type of earring accessory design, that may be desired. In each case, the earring accessory is preferably provided with a small attachment ring 9 at the upper end thereof, as shown with each of the earring accessories 3, 5 and 7, to facilitate mounting of the earring accessories relative to the earring holder 1, now to be described.

Referring now to FIGS. 1–4 of the drawing, it will be seen that the earring holder 1 includes an earring holder body 11 which is generally semi-spherically shaped except at a lower end 13 and a rear face 15. Specifically, the lower transverse end of the semi-spherically shaped earring holder body 11 includes a flat or planar surface 13 which is shown in the drawings to be generally horizontally directed, based on the orientation of the earring holder 1 shown in FIGS. 1–3 of the drawings.

As will be understood in the discussion that follows, the earring holder 1 may be formed in any shape desired, although the lower end thereof is preferably formed as a flat or planar surface 13 which is generally horizontally directed, based on the orientation of the earring holder 1 as shown in the drawing.

The semi-spherically shaped earring holder body 11 includes a flat or planar rear face 15 that extends generally transverse to the flat or planar transverse lower end surface 13. An ear piercing post 17 extends generally transverse to the rear face 15 of the earring holder 1 and receives a clutch 19 thereon for attachment to a user's ear, in a well known manner. Various other types of ear attachment means, such as those disclosed in U.S. Pat. No. 4,869,078, incorporated herein by reference, may be used including a curvilinear ear hole hook connected to the earring holder body, an adjustable clip connected to earring holder body and adapted to be mounted relative to an ear lobe, with the adjustable clip including either a rotatably mounted adjustable ear dad or for a spring biased clip, adapted to engage an ear lobe of a user. All of these various ear attachment means are disclosed in the aforementioned patent, and further are quite common in the earring art.

Figure 4:
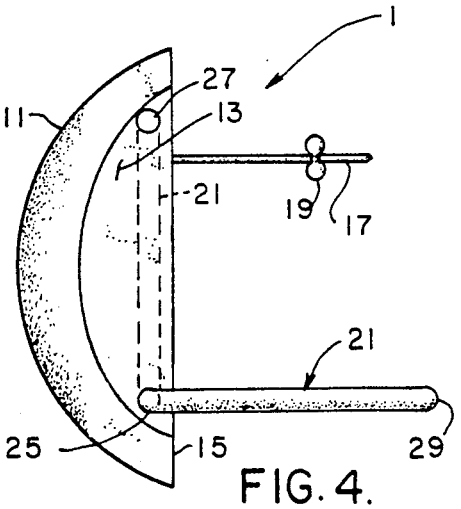
FIG. 4 is a bottom plan view of the earring holder in FIGS. 1–2 and illustrating in full lines the position of the hook shaped member in an open position extending generally transverse to the earring holder body, and in dotted lines, illustrating how the hook shaped member is moved to a closed position generally aligned with the earring holder body for releasable interlocking therewith.

For attaching any one of the various interchangeable earring accessories 3, 5, 7 and the like to the earring holder 1, a hook shaped member 21 is pivotally mounted to the lower transverse end wall 13 of the earring holder body 1. Specifically, the hook shaped member 21 includes an upwardly extending threaded post 23 which is threadably engaged within the earring holder body 1. The threaded post 23 is threadably received in complementary threaded hole 25 formed in the earring holder body 11 and extending upwardly from the transverse end wall 13 thereof. It will be noted that the threaded post 23, as best seen in FIG. 4 of the drawing, is positioned adjacent outer marginal areas of the lower transverse end wall 13 and is generally aligned relative to a depression 27 formed upwardly and into the lower transverse end wall 13 of the earring holder body 11.

The hook-shaped member 21 is thus adapted to be quickly and quite simply threadably attached to the earring holder body 11, in threaded engagement with the threaded post 23 and the complementary threaded hole 25 formed in the earring holder body 11.

The construction of the hook-shaped member 21 is such that following threaded engagement of the hook shaped member 21 relative to the earring holder body 11, the outer free end 29 of the hook shaped member 21 is operably adapted to releasably engage the depression 27 formed in the lower transverse end wall 13, in releasable locked engagement therewith. In this regard, the hook shaped member 21 is preferably constructed as a spring member, such as from "spring gold" or the like in order that the outer free end 29 of the hook shaped member 21 can be mounted in spring biased releasable engagement with the depression 27 formed in the lower transverse end wall 13 of the earring holder body 11.

It will also be understood that the hook shaped member 21 can be constructed such that the outer free end 29 thereof, even without the "spring gold" construction, may nonetheless releasably engage or snap into the depression 27 in locking engagement therewith, such as by an interference or snap fit therebetween. Other similar releasable interlocking arrangements are contemplated in this regard and are within the scope of subject matter of this invention, as disclosed.

Figure 1:
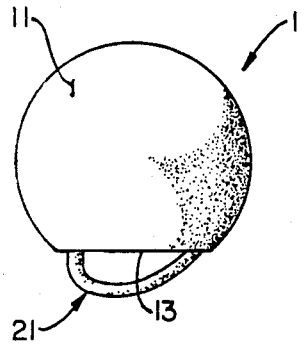
FIG. 1 is a front elevational view of an earring holder, constructed in accordance with the teachings of the present invention, for interchangeably receiving at least one of a variety of different earring accessories.
Figure 2:
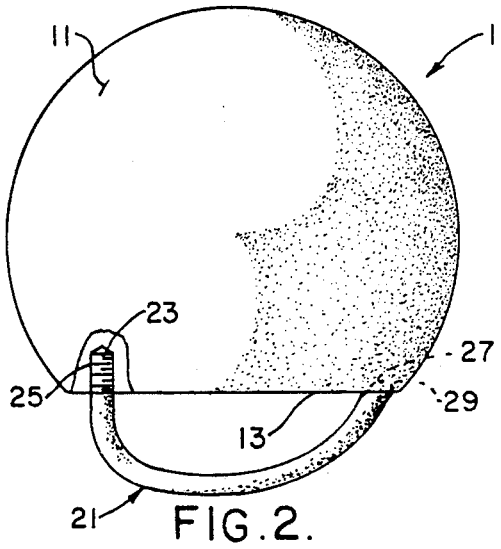
FIG. 2 is an enlarged front elevational view of the earring holder shown in FIG. 1, illustrating the manner in which the hook shaped member thereof is threadably mounted at one end to an earring holder body and is releasably interlocked at the other end to the holder body.
Figure 3:
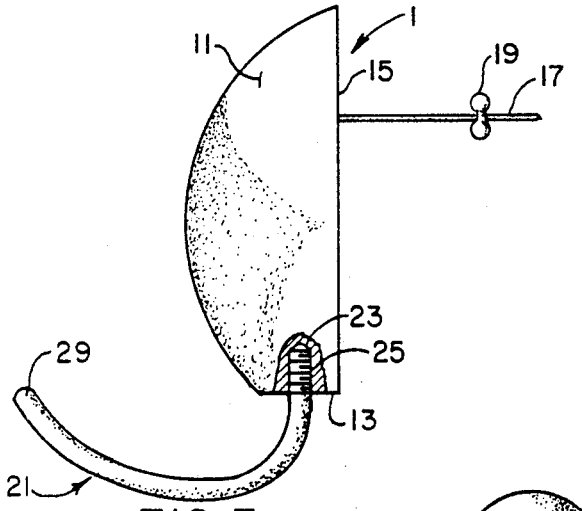
FIG. 3 end elevational view of the earring holder shown in FIGS. 1–2 with the hook-shaped member thereof located in an open position for interchangeably receiving at least one of a variety of different earring accessories.

The purpose of the aforesaid construction is to allow the hook shaped member 21 to be pivotally moved from its closed position, generally aligned with the earring holder body 11 as shown in FIG. 2 and in the dotted line illustration of FIG. 4, to an open position, such as shown in full lines in FIGS. 3–4 of the drawings. In its open position, the hook shaped member 21 extends generally transversely to the earring holder body 11, to enable a user to thread the small attachment rings 9, attached to the various earring accessories 3, 5 or 7, over the outer free end 29, and onto the body of the hook shaped member 21. Thereafter, the hook shaped member 21 may be pivoted about the threaded post 23 for re-engagement of the outer free end 29 thereof with the depression 27 in releasable or snap locking engagement therewith. The earring accessory thus mounted on the hook shaped member 21 of the earring holder body 11 will be securely positioned and retained on the earring holder 1.

When it is desired to remove and replace one of the earring accessories with another accessory, it is a simple matter to disengage the outer free end 29 of the hook shaped member 21 from the depression 27 in the lower end of the earring holder body 11, allowing the hook shaped member 21 to be swung from its closed to its open position, as shown in the drawings. Another earring accessory may then be mounted to the hook shaped member through the small attachment ring 9. Thereafter, the hook shaped member 21 may be pivotally rotated to closed or locked position relative to the earring holder body 11, as explained above.

In view of the above, it will be seen that the several objects and features of this invention are achieved and other advantageous results obtained As various changes could be made in the above constructions without departing from the scope of the invention, it is intended that all matter contained in the above description or shown in the accompanying drawings shall be interpreted as illustrative and not in a limiting sense.

I claim:

1. In an earring holder for interchangeably receiving at least one of a variety of different earring accessories and including an earring holder body and ear attachment means operably associated with said earring for attaching said earring holder to a user's ear, the improvement comprising:

earring support means including a hook shaped member pivotally mounted relative to a lower end of said earring holder body, said hook shaped member being pivoted between an open position extending generally transverse to said earring holder body for interchangeably receiving at least one earring accessory and a closed position where said hook shaped member is generally aligned with said earring holder body, said hook shaped member and said earring holder body being constructed for releasable locking engagement therebetween when said hook shaped member is moved between its open and closed positions relative to said earring holder body, and said hook shaped member being threadably engaged to said earring holder body in the area of the pivotal mounting thereof.

2. The improvement as defined in claim 1 wherein said hook shaped member includes a threaded post for complementary threaded engagement relative to said earring holder body, and said hook shaped member being pivotally mounted to said earring holder body along said threaded post while said threaded post is also threadedly engaged to said earring holder body.

3. In an earring holder for interchangeably receiving at least one of a variety different earring accessories and including an earring holder body and ear attachment means operably associated with said earring for attaching said earring holder to a user's ear, the improvement comprising:

earring support means including a hook shaped member pivotally mounted relative to a lower end of said earring holder body, said hook shaped member being pivoted between an open position extending generally transverse to said earring holder body for interchangeably receiving at least one earring accessory and a closed position where said hook shaped member is generally aligned with said earring holder body, said hook shaped member and said earring holder body being constructed for releasable locking engagement therebetween when said hook shaped member is moved between its open and closed positions relative to said earring holder body, and said hook shaped member being threadably engaged to said earring holder body in the area of the pivotal mounting thereof, said hook shaped member including an outer free end which is constructed to releasably engage the lower end of said earring holder body.

4. The improvement as defined in claim 3 wherein said earring support means includes a depression formed in the lower end thereof for receiving the outer free end of the hook shaped member in releasable locking engagement therewith.

5. The improvement as defined in claim 4 wherein said hook shaped member is constructed as a one-piece, curvilinearly extending hook shaped spring member enabling the outer free end thereof to be mounted in spring biased releasable mounted engagement with a depression formed in the lower end of the earring holder body.

6. The improvement as defined in claim 5 wherein said hook shaped spring member is constructed from a spring material.

7. In an earring holder for interchangeably receiving at least one of a variety of different earring accessories and including and earring holder body and ear attachment means operably associated with said earring for attaching said earring holder to a user's ear, the improvement comprising:

earring support means including a hook shaped member pivotally mounted relative to a lower end of the earring holder body, said hook shaped member being pivoted between an open position extending generally transverse to said earring holder body for interchangeably receiving at least one earring accessory and a closed position where said hook shaped member is generally aligned with said earring holder body, said earring holder body including a depression formed in a lower end thereof for receiving an outer free end of the hook shaped member in releasable locking engagement therewith when the hook shaped member is moved between its open and closed positions relative to said earring holder body and said hook shaped member also threadably engaged to said earring holder body in the area of pivotal mounting thereof.

8. The improvement as defined in claim 7 wherein said hook shaped member is constructed as a spring member enabling the outer free end thereof to be mounted in spring biased releasable engagement with the depression formed in the lower end of said earring holder body.

9. The improvement as defined in claim 7 wherein said hook shaped member is constructed as a one-piece, curvilinearly extending hook shaped spring member with a threaded post for complementary threaded mounted to the earring holder body as well as pivotal mounting thereto.

* * * * *